United States Patent [19]

Levine

[11] 4,006,390

[45] Feb. 1, 1977

[54] POCKET SIZED NON-LETHAL ELECTRICAL WEAPON

[76] Inventor: Alfred B. Levine, 2924 Terrace Drive, Chevy Chase, Md. 20015

[22] Filed: Nov. 20, 1975

[21] Appl. No.: 633,905

[52] U.S. Cl. ..... 317/262 S; 124/16; 273/84; 231/2 E

[51] Int. Cl.[2] ..... B68B 11/00

[58] Field of Search ..... 317/262 S; 124/16; 273/84 ES; 272/27 N; 43/6; 231/2 E

[56] References Cited

UNITED STATES PATENTS

| | | | |
|---|---|---|---|
| 3,246,895 | 4/1966 | Traill | 124/16 X |
| 3,484,665 | 12/1969 | Mountjoy et al. | 317/262 S |
| 3,523,538 | 8/1970 | Shimizu | 317/262 S |
| 3,722,788 | 3/1973 | Petrecz | 273/84 ES |

*Primary Examiner*—R. N. Envall, Jr.
*Attorney, Agent, or Firm*—Paris Haskell & Levine

[57] ABSTRACT

A nonlethal weapon providing high voltage electrical shocking potential. When not in use, the weapon is contracted or collapsed to a small size for conveniently carrying it in the pocket or purse, and is rapidly put into active use by triggering the extension of an elongatable probe carrying the high voltage contacts.

8 Claims, 6 Drawing Figures

FIG. 1
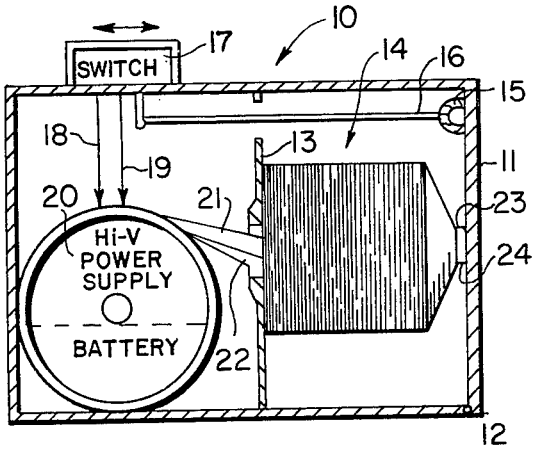
FIG. 5
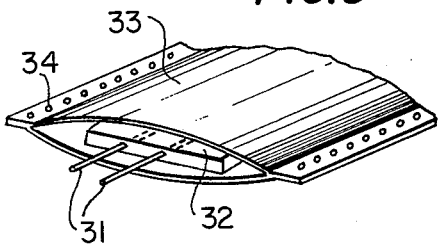
FIG. 4
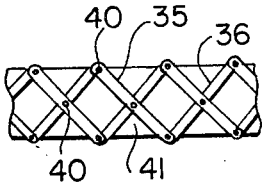
FIG. 2
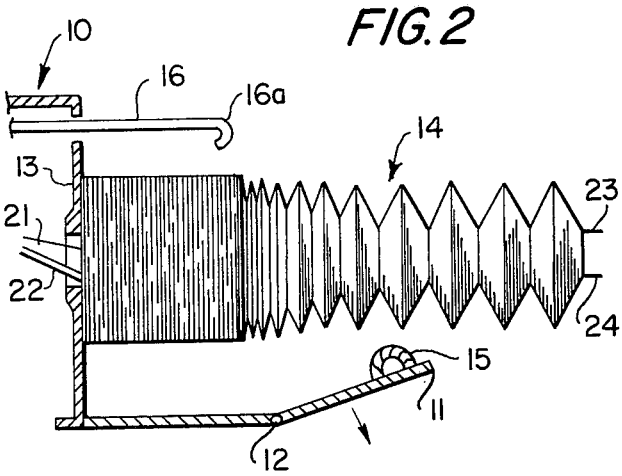
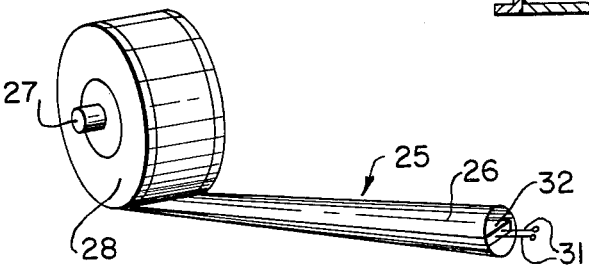
FIG. 3
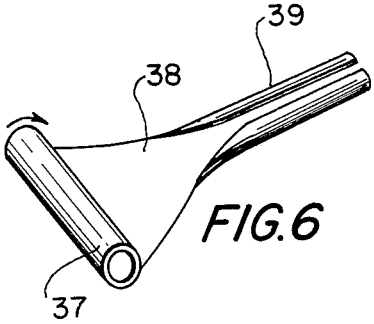
FIG. 6

POCKET SIZED NON-LETHAL ELECTRICAL WEAPON

STATEMENT OF THE INVENTION

This invention relates to non-lethal weapons of the type producing an electrical shocking voltage, and is particularly concerned with such weapons that are small, portable, and easily carried in the hand or pocket.

BACKGROUND

Electrical shocking devices known in the art have generally been in the form of a cattle prod, policeman's billy club, electrified spear; or more recently, an electrified projectile such as a small dart, adapted to be propelled to a target while connected to its remote high voltage powering source by means of a fine wire that is uncoiled as the dart is propelled.

The electrified cattle prod, billy club, or spear types of such weapons are not easily carried in the pocket or purse and are therefore not a convenient weapon that might be used for self-protection by persons while engaged in normal day-to-day activities. The electrically charged propellable dart devices, on the other hand, are altogether too complex and too expensive for such ordinary defensive uses, and additionally, suffer from the disadvantage that in the event the projectile misses its target, the weapon is rendered useless unless the weapon is capable of launching multiple projectiles. Furthermore, such projectile ejecting weapons require a degree of skill on the part of the user in the aiming and firing of the dart or darts.

SUMMARY OF THE INVENTION

Briefly, according to the present invention there is provided an electrified weapon than can be accomodated in pocket sized, miniature form yet be as useful as an elongated prod or billy club in subdueing an assailant. In a preferred embodiment, the weapon is comprised of a high voltage powering source together with an extendable and retractable prod carrying its high voltage contacts. The prod is quickly and positively projected to its elongated position, that may extend up to a foot or more from the user, and in such extended position, may be applied against or close to, an assailant, thereby to effectively protect the user against attack.

DRAWINGS

FIG. 1 is a side sectional view of a preferred embodiment showing the prod in its retracted position;

FIG. 2 is a partial view, similar to FIG. 1, showing the prod being released and entering into extended position;

FIG. 3 is a perspective view of an alternative type of extendable-retractable prod;

FIG. 4 is a partial side view of still a different type of extendable-retractable prod; and FIGS. 5 and 6 are perspective views of portions of still different types of extendable-retractable prods.

DESCRIPTION OF PREFERRED EMBODIMENTS

In a preferred embodiment shown in FIGS. 1 and 2, the weapon includes an outer housing 10 of miniature size and light in weight that is adapted to be easily carried in the hand, pocket, or purse of the user. Housing 10 includes a forward door 11 hinged at 12 to pivotally open into the position shown in FIG. 2, when the external slide switch button 17, supported on the upper wall of the housing, is positioned to a forward location. As shown, positioning of the switch button 17 forwardly, advances a suitable latching lever 16 to disengage with an eyelet or ring 15 on the inside of the forward door 11, thereby releasing the door 11 and permitting it to open about its hinge 12.

Housing 10 is preferably formed of a suitable semi-rigid plastic material that is inexpensive, sufficiently durable, and provides a reasonably good electrical insulation. The door 11 of plastic may be made integral with the bottom wall and provided with an integral plastic hinge 12. The latch lever 16 located inside of the housing is attached at its inner end to a portion of the slide switch disposed inside, and at its far end is provided with a suitable hook 16*a*, as shown, or other catch means, to detachably engage with the ring 15 or eyelet on the inside of door 11.

Inside of the housing 10 is provided an upright divider wall 13; and sandwiched between this wall 13 and the door 11 is disposed a hollow bellows 14 that is shown in its compressed or retracted position in FIG. 1 when the door 11 is closed, and in its expanded or projected position in FIG. 2 when the door 11 is released. When the operating switch 17 is positioned forwardly to operate the weapon, and releases the latching means 15 and 16, as described above, the self-expansion force of the compressed bellows 14 forces the door 11 to its open position shown in FIG. 2, permitting the bellows 14 to further expand and project outwardly for a distance away from the housing 10 as shown. For effective use as a weapon, the bellows 14 should project for a distance up to one foot or more away from the housing and be constructed as to provide a reasonable degree of rigidity, without undue sagging, so that the user may laterally reposition this expandable prod to avoid any attempt at evasive manuevering by an assailant. The length of extension of the prod 14 is not considered to be critical but should, of course, be sufficiently long so as to place the user beyond the arm's length reach of an assailant. Conversely, the prod 14 should not be too long since this would render the weapon awkward and ungainly to rapidly erect, and to rapidly position as might be necessary to counter the movements of an attacher.

As shown, the bellows 14 is preferably made hollow to contain the fine electrical leads or conductors 21 and 22 as shown, that provide electrical high voltage energization to the remote electrical contacts 23 and 24 at the projected attack end of the prod 14. When the weapon is in its stored position of FIG. 1, the prod 14 is retracted and the electrical contacts 23 and 24 are confined inside the plastic housing 10, as shown. However, when the weapon is activated by operation of the switch 17, as shown in FIG. 2, the compressed bellows 14 is released from its retracted position and expands outside and away from the housing 10 to extend the high voltage contacts 23, 24 at a distance of up to a foot or more away from the housing 10 and the user.

Operation of the operating switch 17 forwardly, also provides an electrical connection over lines 18 and 19 to the high voltage power supply 20 located inside of the housing and to the rear of the divider wall 13, as shown. High voltage generators for producing shocking votages up to 50,000 volts or greater with low current output, as may be employed in practicing the invention, are well known to those skilled in the art and are available on the open commercial market. A typical battery operated electrical shock current generator employing a circuit breaking vibrator and high ratio step-up transformer is shown in FIG. 2 of Shimuzur U.S. Pat. No. 3,523,538. A typical battery operated electronic circuit for this same purpose is shown by FIG. 2 of the Blanc U.S. Pat. No. 3,626,626.

Although a battery operated power supply of these types is desirable, alternative self-powered miniature electrical high voltage generators are also available and may be employed for this purpose. For example, hand pumped piezoelectric generators are available for generating high voltages as described in the Rixon U.S. Pat. No. 3,211,069. Similarly, the Yamano U.S. Pat. No. 3,558,903 discloses a ceramic piezoelectric generator provided with a hand lever operated activator mechanism, and the Maltner et al U.S. Pat. No. 3,396,311 shows a similar hand operated piezo-electric voltage generator used to produce high voltage sparks for igniter purposes.

If desired, more conventional miniature selfpowered electromotive generators may be employed. These have been available for many years for powering "batteryless flashlights" as disclosed in the early Alexander U.S. Pat. No. 2,277,897 or Bernasconi et al no. 1,956,339, or even earlier in Dravillat No. 1,489,431 or Evans U.S. Pat. No. 1,411,615. These hand held electromotive generators use wind-up springs to rapidly rotate the small rotors, or alternatively employ levers or gear drives that enable the user to repetitively squeeze a lever to rotate the rotor at high speed in a magnetic field. These self-powering magnetomotive generators when combined with a high voltage step-up transformer may be employed to produce a very high voltage shocking potential useful in the practice of the present invention.

FIGS. 3 to 6, inclusive show alternative types of expandable-contractable probes that may be employed in practicing the invention. In FIG. 3, the probe is in the form of a hollow plastic or metal tube 25 constructed of two flexible strips 26 joined along their longitudinal edges 29 in overlapped fashion, as shown, in such manner that the tube may be compressed or flattened and wound as a spring coil 28 onto a reel 27 or mandrel. In this construction, the bending stress on the strips 26 seeks to have the coil 28 normally unwind itself and open up to its hollow tubular form as shown at the end portion in FIG. 3. Inside of the hollow tube 25 is disposed a thin flexible flat insulator strip 32 containing a pair of conductors 31 for applying the high voltage electrical shocking voltage generated by the weapon. In use, the coiled tube 28 is confined inside of a housing similar to housing 10 of FIG. 1, and when the housing door 11 is unlatched, the coil 28 unreels itself to project the electrical contact leads at the desired distance away from the housing.

FIG. 5 shows a slightly different manner of constructing the self-unreeling expandable prod. In this embodiment, a pair of flexible strips 33 of plastic or thin metal are welded along their longitudinal edges at 34 to provide a hollow tubular construction that normally seeks to open into an oval cross sectional shape instead of the circular cross-section of FIG. 3. The operation is otherwise the same as in FIG. 3.

In FIG. 6, the self-unreeling probe is formed of a single web or strip 38 of thin flexible metal or plastic that is suitably formed or treated to normally seek to curl up along its edges 39, as shown. This strip is flattened and wound into a spring coil 37 and disposed inside of the housing when the weapon is not in use. When released by unlatching of the housing door, the strip 38 automatically self-unwinds from the reel 37 in a manner as described above, to project the probe contacts outside of the housing for the desired distance. The electrical conductors and high voltage contacts may be supported directly onto the strip 38, as a printed circuit (not shown), or alternatively, a thin insulator strip carrying fine conductors and end contacts, (such as the members 31 and 32 of FIG. 5) may be attached to strip 38 by adhesive or otherwise.

In FIG. 4, the expandable-contractable probe is in the form of an expansion beam, constructed of a series of levers 35 and 36 pivotally interconnected together at 40 in a well known scissors arrangement. In this embodiment, springs 43 are employed to normally compell the beam or boom toward its extended or expanded position. When the weapon is not in use, the boom is compressed or contracted inside of the housing, as described above, and is sandwiched between the wall 13 and door 11 in the same manner, as in FIG. 1. The fine electrical conductors for interconnecting the end contacts (not shown) with the power source within the housing may be contained within a flat flexible insulator 41, such as 32 in FIGS. 3 and 5, that is suitably supported by the lever arms 35 and 36.

In all of the above described embodiments, the expandable or extensible probe is adapted to be automatically extended upon opening of the door 11 by means of springs; or by means of the self-extending operation of a compressed bellows, or by the uncoiling of a leaf type spring or pair of such springs. Alternatively, for positive assured operation, a compressed air cartridge, instead of a spring, may also be included within the housing 10 and be actuated by operation of the switch 17 to release pressurized air into the bellows to expand the bellows probe of FIGS. 1 and 2, or into a closed end tube (not shown) to unreel such tube from a coil. For resetting of the weapon, the switch 17 may be retracted to disconnect the power supply 20 from the conductors and high voltage shocking contacts, and the expanded or extended probe may be manually recompressed or retracted (if a bellows or scissors beam) to its original position inside the housing. Similarly, the extended spring prods of FIGS. 3, 5, or 6 may be flattened and manually rewound into its original coil inside of the housing, thereby being reset in readiness for a future use.

To prevent any inadvertant, or deliberate, unwanted operation of the switch 17 such as when the weapon is disposed in the pocket or purse, or otherwise when the user does not wish the weapon to be operated, a safety device may be employed. Such a safety may be merely in the form of a simple mechanical lock or latch interengaging the switch 17 with housing 10 and preventing movement of the switch 17 until the safety lock is separately operated. Alternatively, an additional electrical switch may be provided in series circuit arrangement with conductors 18 and 19, preventing energization of the shocking contacts by the power source 20 until switch 17 and the safety switch are both operated. Any combination of such electrical and/or mechanical safety devices may be employed, such as a "squeeze" switch that requires the user to squeeze the housing in his hand in order to operate a separate safety switch. Such squeeze type mechanisms are well known and commonly employed in mechanical form in automatic type hand carried firearms.

I claim:

1. A non-lethal electrical shocking weapon that is self-powered and produces a high voltage shocking potential comprising:

a powering source and manually operated switching means, electrically conductive contactor probes interconnected to said powering source through said switching means, and through elongated electrical conductor means, and a deployable supporting member for said contactor probes that when not in use reposes within a small confined volume adjacent said powering source and when extended, serves to project said contactor probes to an extended position at a distance from said power source while supporting said probes in a manner that permits positioning by the user.

2. In the weapon of claim 1, said switching means when manually operated conjointly applying power to said contactor probes and releasing said deployable supporting member to project the probes to said extended position.

3. In the weapon of claim 1, said powering source comprising a battery, and said supporting member comprising a self erecting member that automatically projects said contactor probes upon operation of said manually operated switching means.

4. In the weapon of claim 1, said supporting member comprising a compressible and extendable bellows.

5. In the weapon of claim 1, said supporting member includes a flexible tube whose walls are normally collapsed to permit folding of the tube in a confined volume, and when released, the tube is self-erecting to provide an extended prod.

6. In the weapon of claim 1, said manually operable switch means provided with a safety mechanism to prevent inadvertant energization of said contactor probes.

7. In the weapon of claim 1, the addition of means preventing energization of said contactors when said deployable supporting member is in repose within said confined volume.

8. In the weapon of claim 1, a small housing for containing said powering source, contactor probes, conductors, and supporting means within a volume small enough to be encompassed by the hand of the user, and said switch means coupled to said housing to enable the projection of said deployable supporting member out of said housing when said switch is activated.

* * * * *